United States Patent [19]

Leuchter

[11] Patent Number: 4,793,073

[45] Date of Patent: Dec. 27, 1988

[54] DEVICE FOR REMOVING MOISTURE FROM WET PROCESSED PHOTOSENSITIVE MATERIAL

[75] Inventor: Jürgen Leuchter, Tutzing, Fed. Rep. of Germany

[73] Assignee: Agfa-Gevaert Aktiengesellschaft, Leverkusen, Fed. Rep. of Germany

[21] Appl. No.: 85,984

[22] Filed: Aug. 14, 1987

[30] Foreign Application Priority Data

Sep. 2, 1986 [DE] Fed. Rep. of Germany ..... 3629794

[51] Int. Cl.[4] ..... F26B 13/00

[52] U.S. Cl. ..... 34/156; 34/160; 34/242

[58] Field of Search ..... 34/92, 160, 242, 156

[56] References Cited

U.S. PATENT DOCUMENTS

| | | | |
|---|---|---|---|
| 1,565,494 | 12/1925 | Patterson | 34/92 |
| 2,008,230 | 7/1935 | Spooner | 34/156 X |
| 2,142,711 | 1/1939 | Birch | 34/160 X |
| 2,590,850 | 4/1952 | Dungler | 34/242 |
| 2,606,046 | 8/1952 | Bonner et al. | 34/242 |
| 3,319,354 | 5/1967 | Hering, Jr. et al. | 34/160 X |
| 3,543,410 | 12/1970 | Trachtenberg | 34/156 X |
| 4,348,817 | 9/1982 | Bradshaw | 34/242 X |
| 4,411,075 | 10/1983 | Blaudszun | 34/242 X |

FOREIGN PATENT DOCUMENTS

| | | | |
|---|---|---|---|
| 849329 | 9/1960 | United Kingdom | 34/242 |

*Primary Examiner*—Steven E. Warner

*Attorney, Agent, or Firm*—Peter K. Kontler

[57] ABSTRACT

An apparatus for continuously developing travelling bands of film has a tank which accommodates a processing bath. A device for the removal of moisture from film leaving the tank is located in the region of the tank exit. The device includes a substantially airtight enclosure having registering slot-like inlet and outlet openings for the film. The inlet and outlet openings divide the enclosure into two portions. A suction nozzle is disposed in each portion and is provided with a suction opening which faces the path of the film. Flexible sealing strips are arranged adjacent to the inlet and outlet openings of the enclosure. When there is no film passing through the enclosure, the sealing strips essentially close the inlet and outlet openings so that a vacuum is maintained in the enclosure. The sealing strips are bent away from the inlet and outlet openings during the passage of film through the enclosure. The flexibility of the sealing strips is sufficiently great that the suction generated by the suction nozzles can cause air cushions to be developed and maintained between the sealing strips and the film. The device makes it possible to uniformly remove moisture from the film without contacting the latter.

21 Claims, 2 Drawing Sheets

DEVICE FOR REMOVING MOISTURE FROM WET PROCESSED PHOTOSENSITIVE MATERIAL

BACKGROUND OF THE INVENTION

The invention relates generally to the wet processing of photosensitive material e.g., the development of photographic paper or film.

More particularly, the invention relates to a device for the removal of moisture from photosensitive material leaving a processing bath.

Conventional apparatus for the continuous wet processing of photosensitive material includes a processing tank which accommodates a processing bath, and a device for the removal of moisture from photosensitive material which has been treated in the bath. The tank is provided with an exit for the travelling photosensitive material, and the moisture removing device is located near such exit. The moisture removing device includes an elongated suction nozzle extending transversely of the path of the photosensitive material and having a suction opening which faces the material. A vacuum unit is connected to the suction nozzle. The moisture removing device further includes a pair of sealing elements disposed on opposite sides of the suction opening.

A moisture removing device of this type is particularly useful for photographic paper films in the production of color copies. Such a device is disclosed in the West German Offenlegungsschrift No. 34 28 361. Here, photographic material is conveyed by a suction nozzle having an elongated suction opening extending transverse to the direction of transport of the material. One side of the material faces the suction nozzle. Sealing elements engage the other side of the material on either side of the suction opening and press the material against the suction nozzle. The material thus contacts the suction nozzle along a short arc. Due to this arrangement, the degree of moisture removal on the two sides of the material is different. Moreover, there is a danger that the material will be scratched.

OBJECTS AND SUMMARY OF THE INVENTION

It is an object of the invention to provide a device which makes it possible to achieve the same degree of moisture removal on both sides of photosensitive material.

Another object of the invention is to provide a device which allows uniform moisture removal to be achieved over the entire width of photosensitive material.

An additional object of the invention is to provide a method which permits uniform removal of moisture from opposite sides of photosensitive material to be achieved.

A further object of the invention is to provide a device which is capable of removing moisture from photosensitive material without contacting the latter.

It is also an object of the invention to provide a method for the removal of moisture from photosensitive material which reduces the likelihood of damage to the material.

The preceding objects, as well as others which will become apparent as the description proceeds, are achieved by the invention.

One aspect of the invention resides in an apparatus for the continuous wet processing of photosensitive material, e.g., the continuous development of photographic paper or film. The apparatus comprises a device for the removal of moisture from photosensitive material issuing from a processing bath and travelling along a predetermined direction. This device, which may be located in the wet processing apparatus or mounted externally of the latter, includes an enlosure having first and second portions, and inlet and outlet openings for photosensitive material between such portions. The device further includes first and second suction nozzles respectively located in the first and second portions, and each of the nozzles has a suction opening facing away from the respective portion of the enclosure, i.e., facing the path of the photosensitive material.

The processing bath may be accommodated in a tank or container having an exit for the travelling photosensitive material, and the moisture removing device may be mounted inside the container or externally thereof in the region of the exit.

The suction nozzles and openings may be elongated and extend transversely of the direction of movement of the photosensitive material. Preferably, the suction nozzles and openings extend across at least the major part of the enclosure as considered transverse to the direction of travel of the material. The suction nozzles are connected to suction generating means which may, include separate vacuum sources for the two nozzles.

The enclosure of the moisture removing device may be substantially airtight. The device may further include a pair of sealing elements disposed on opposite sides of the suction openings. One of these sealing elements may be disposed between the inlet opening of the enclosure and the suction openings while the other is disposed downstream of the outlet opening of the enclosure. The sealing elements are advantageously arranged to at least partially close the inlet and outlet openings when the moisture removing device is idle.

The moisture removing device of the invention provides the advantage that uniform moisture removal from both sides of the photosensitive material may be achieved. This is true even for a wet processing apparatus which is designed to treat a plurality of bands of photosensitive material travelling side-by-side along parallel paths. In fact, a uniform degree of moisture removal may here be achieved at all locations across the width of such apparatus regardless of whether or not all the paths are occupied.

To initiate advance of a band of photosensitive material through a wet processing apparatus, the leading end of the band is generally engaged by a travelling clamp which draws the leading end through the apparatus. In an apparatus designed to process a plurality of bands of photosensitive material travelling along parallel paths the moisture removing device of the invention makes it possible to achieve a uniform degree of moisture removal at all locations across the width of the apparatus even when a clamp is being drawn along one or more of the paths.

The moisture removing device according to the invention provides the further advantage that uniform removal of moisture from both sides of a band of photosensitive material may be achieved without contacting the material. This allows the likelihood of damage to the photosensitive material to be reduced.

Moreover, by suctioning moisture from both sides of the photosensitive material, the device of the invention may be made so compact that the output of the vacuum source or sources for the suction nozzles may be kept very low. The device may further be made small enough to allow the latter to be disposed at the connections between different processing tanks or containers without significantly increasing the size of the wet processing apparatus.

The moisture removing device in accordance with the invention may be employed for film having an emulsion on one or both surfaces as well as for paper which is provided with an emulsion on one of its surfaces.

The novel features which are considered as characteristic of the invention are set forth in particular in the appended claims. The improved moisture removing device itself, however, both as to its construction and its mode of operation, will be best understood upon perusal of the following detailed description of certain specific embodiments with reference to the accompanying drawings.

DESCRIPTION OF THE PREFERRED EMBODIMENTS

Figure 1:
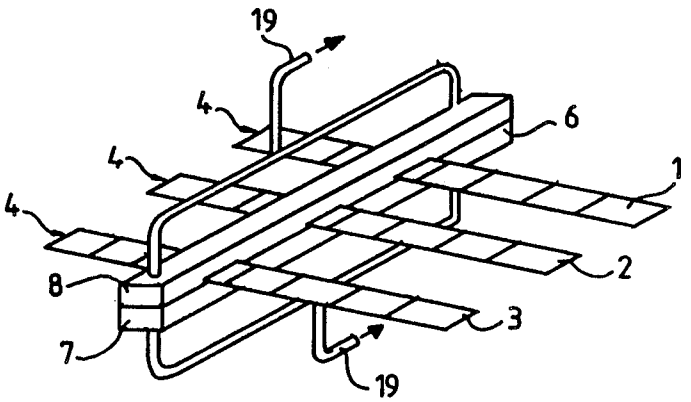
FIG. 1 is a perspective view of a device according to the invention for removing moisture from photosensitive material.

FIG. 1 shows a device according to the invention for the removal of moisture from the surfaces of three bands or strips 1,2,3 of photosensitive material. The bands 1,2,3 may, for instance, be constituted by roll films or photographic paper. The bands 1,2,3 are conveyed side-by-side along parallel paths in the direction indicated by the arrows 4.

The moisture removing device forms part of an apparatus for the wet processing of photosensitive material, e.g., an apparatus for developing photosensitive material. The components of the wet processing apparatus other than the moisture removing device have not been illustrated since they are conventional and do not constitute part of the invention per se. The moisture removing device may be disposed inside the wet processing apparatus or may be mounted externally thereof.

The bands 1,2,3 issue from a processing tank or container forming part of the wet processing apparatus and accommodating a processing bath. The moisture removing device may function to remove excess moisture from the two surfaces of each of the bands 1,2,3 prior to entry of the latter into a dryer. To this end, the moisture removing device may be located internally of the tank in the region of the exit for the bands 1,2,3 or mounted externally of the tank downstream of the exit.

In order to advance the bands 1,2,3 through the wet processing apparatus, the leading ends of the bands 1,2,3 are normally connected to drag chains or conveyors by means of clamps. The drag chains or conveyors then pull the bands 1,2,3 through the wet processing apparatus in the direction 4. Accordingly, the clamps must pass through the moisture removing device. There can thus be a situation inside the moisture removing device where one of the paths currently occupied by the bands 1,2,3 is occupied by a clamp; another path is empty; and the third path is occupied by a band similar to the bands 1,2,3. Even under such circumstances, the removal of moisture from the two surfaces of a band must proceed with consistently uniform quality independently of whether or not neighboring paths are occupied by bands of photosensitive material.

Figure 3:
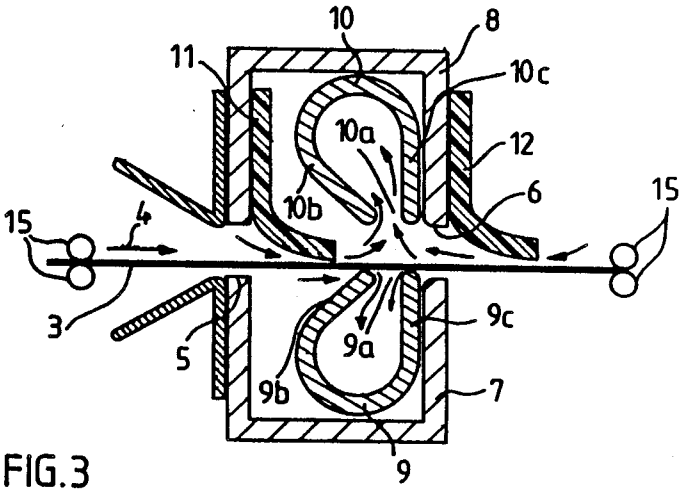
FIG. 3 is similar to FIG. 2 but shows the moisture removing device during operation.
Figure 2:
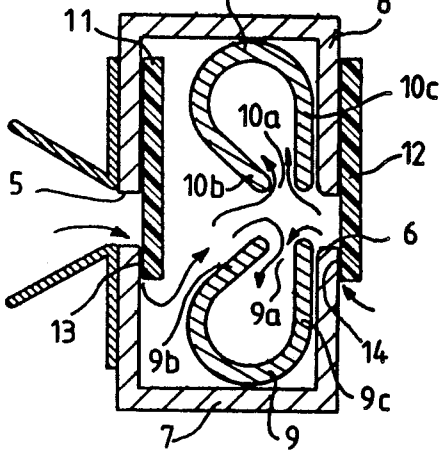
FIG. 2 is a transverse sectional view of a first embodiment of the moisture removing device of the invention during an idle period.

Referring now to FIGS. 2 and 3 in conjunction with FIG. 1, the moisture removing device is, to this end, provided with an essentially airtight enclosure or housing which is divided into a lower portion 7 and an upper portion 8 by one or more inlet openings or slots 5 and one or more outlet openings or slots 6 for the bands 1,2,3. A tubular suction nozzle 9 is mounted in the lower portion 7 of the enclosure in any suitable manner while a second tubular suction nozzle 10 is mounted in the upper portion 8 of the enclosure in any appropriate fashion. The suction nozzles 9 and 10 are thus disposed on opposite sides of the paths of the bans 1,2,3. The suction nozzles 9, 10 are elongated and extend perpendicular to the direction of travel 4, and parallel to the paths, of the bands 1,2,3. The lower suction nozzle 9 has an elongated suction opening or slot **9*a* which faces away from the lower enclosure portion 7 and is directed towards the paths of the bands 1,2,3 from below. Similarly, the upper suction nozzle 10 has an elongated suction opening or slot 10*a* which faces away from the upper enclosure portion 8 and is directed towards the paths of the bands 1,2,3 from above. The bands 1,2,3 accordingly pass between the suction openings 9*a*,10*a* so that excess moisture is suctioned from both surfaces of each band 1,2,3. The suction nozzles 9,10 and suction openings 9*a*,10*a* preferably extend across at least the major part of the width of the enclosure 7,8 as considered perpendicular to the direction of travel 4 of the bands 1,2,3 and advantageously extend across such width virtually in its entirety. Each of the suction nozzles 9,10 is connected to a conventional vacuum source of appropriate design. A common vacuum source may be provided for both of the suction nozzles 9,10. Alternatively, as illustrated in FIG. 1, each suction nozzle 9,10 may be connected to an individual vacuum source including a vacuum line 19**.

With reference again to FIGS. 2 and 3, a flexible sealing element or strip 11 is mounted on the upper enclosure portion 8 immediately downstream of the inlet opening 5. Similarly, a second flexible sealing element or strip 12 is mounted on the upper enclosure portion 8 immediately downstream of the outlet opening 6. The sealing strips 11 and 12 are thus located on opposite sides of the nozzles 9 and 10. When the moisture removing device is idle as in FIG. 2, that is, when the paths inside the enclosure 7,8 are empty, the sealing strips 11 and 12 overlie or cover the inlet opening 5 and outlet opening 6, respectively. Consequently, the flow cross section through which air can be drawn into the enclosure 7,8 from the outside is greatly reduced. As indicated by the unnumbered flow arrows in FIG. 2, during periods of idleness of the moisture removing device, air from the outside can enter the enclosure 7,8 only through narrow gaps and 14 defined by the lower enclosure portion 7 and the respective sealing strips 11 and 12. The amount of air which can be drawn into the enclosure 7,8 when the moisture removing device is idle is thus very small so that a vacuum is maintained in the enclosure 7,8.

On the other hand, when the moisture removing device is operative, that is, when one or more of the bands 1,2,3 is pulled, pushed or otherwise advanced through the enclosure 7,8, the sealing strips 11 and 12 are bent up and away from the inlet opening 5 and the outlet opening 6 as shown in FIG. 3. The direction of bending is such that the sealing strips 11 and 12 project downstream of the inlet opening 5 and outlet opening 6, respectively. The flexibility of the sealing strips 11,12 is so great that the suction created at the suction openings **9*a*,10*a* can cause air cushions to form and be maintained between the upwardly bent sealing strips 11,12 and the surfaces of the bands 1,2,3 facing the same. The sealing strips 11,12 then do not rub against the bands 1,2,3. If the bands 1,2,3 have an emulsion on one surface only, it is preferred for this surface to be directed towards the sealing strips 11,12**.

The reference numeral 15 in FIG. 3 identifies conventional means for guiding and transporting the bands 1,2,3 along their respective paths in the direction 4. The guiding and transporting means 15, and hence the paths of the bands 1,2,3, are arranged such that the distance between the upper surfaces of the bands 1,2,3 and the upper edges of the inlet opening 5 and outlet opening 6, i.e., the lower edges of the upper enclosure portion 8, exceeds the distance between the lower surfaces of the bands 1,2,3 and the lower edges of the inlet opening 5 and outlet opening 6, i.e., the upper edges of the lower enclosure portion 7. By providing for those surfaces of the bands 1,2,3 which face away from the sealing strips 11,12 to be located nearer the confronting edges of the inlet opening 5 and outlet opening 6 than those surfaces which are directed towards the sealing strips 11,12, only small amounts of air can flow into the enclosure 7,8 on the sides of the bands 1,2,3 remote from the sealing strips 11,12 as indicated by the unnumbered flow arrows. As a result, air cushions can also develop between the surfaces of the bands 1,2,3 remote from the sealing strips 11,12 and the neighboring edges of the inlet opening 5 and outlet opening 6. The surfaces of the bands 1,2,3 facing away from the sealing strips 11,12 are thus prevented from coming into contact with the confronting edges of the inlet opening 5 and outlet opening 6.

From the points of view of manufacturing and uniformity of action, it is desirable for the two suction nozzles 9,10 to have identical cross sections. It is particularly advantageous for each of the suction nozzles 9,10 to be constituted by a part-circular section which circumscribes an angle greater than 180° and a pair of convergent legs extending from the part-circular section and defining the respective suction opening **9*a*,10*a*. The reference numerals 9*b*,9*c* identify the legs of the suction nozzle 9 while the reference numerals 10*b*,10*c* identify the legs of the suction nozzle 10**.

The downstream side of each of the portions 7,8 of the enclosure is bounded by a vertical wall which is normal to the paths of the bands 1,2,3 and to the direction of travel 4 of the latter and these walls are in register with one another. The suction nozzle 9 is preferably arranged at the downstream side of the lower enclosure portion 7 such that the leg **9*c* is adjacent, and extends parallel, to the vertical downstream wall of the lower enclosure portion 7. Similarly, the suction nozzle 10 is preferably disposed at the downstream side of the upper enclosure portion 8 in such a manner that the leg 10*c* is adjacent, and extends parallel, to the vertical downstream wall of the upper enclosure portion 8. The legs 9*c*,10*c* are thus located at the downstream sides of the respective suction nozzles 9,10 and are parallel to the outlet opening 6 and perpendicular to the paths of the bands 1,2,3 and the direction 4. The legs 9*b*,10*b*, on the other hand, are located at the upstream sides of the respective suction nozzles 9,10 and converge towards one another as considered in the direction of travel 4 of the bands 1,2,3. By virtue of this arrangement, the legs 9*b*,10*b* cooperate to define a funnel-shaped inlet for the bands 1,2,3 entering the region between the suction nozzles 9,10. This funnel-shaped inlet, which enhances guidance of the bands 1,2,3 between the suction nozzles 9,10**, can be created without additional expense.

As illustrated, the suction nozzles 9,10 are advantageously mirror-symmetrical to one another with reference to a plane which passes between the suction nozzles 9,10 and is parallel to the paths of the bands 1,2,3. The suction openings **9*a*,10*a*** are then in register with one another.

Figure 5:
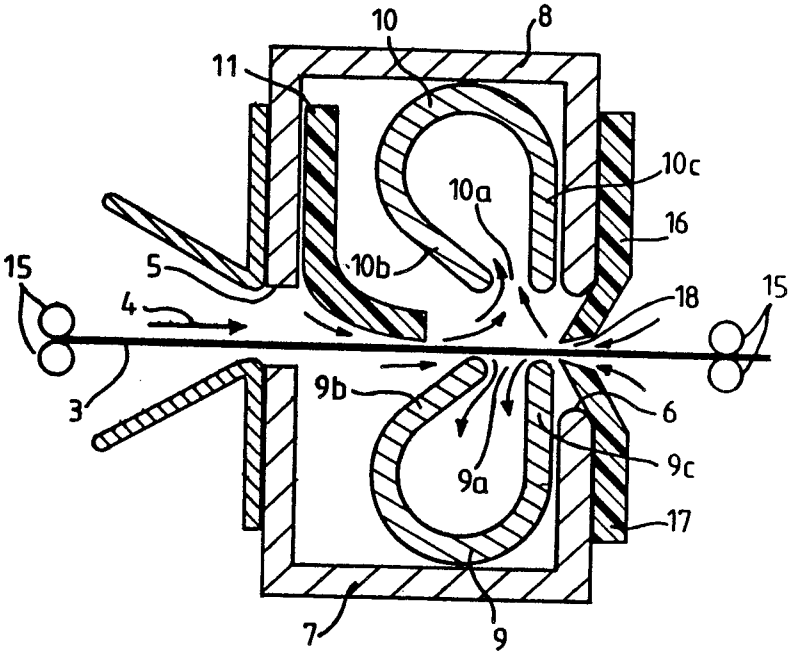
FIG. 5 is similar to FIG. 4 but shows the moisture removing device during operation.
Figure 4:
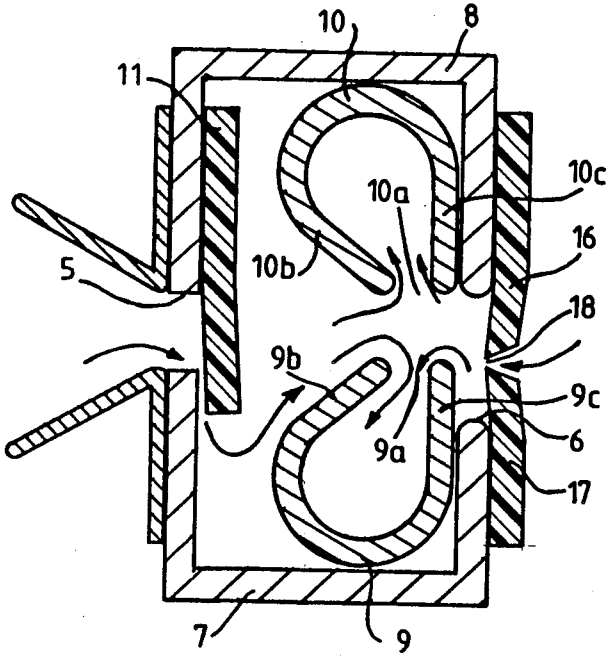
FIG. 4 is similar to FIG. 2 but illustrates a second embodiment of the moisture removing device.

Turning to FIGS. 4 and 5, the same reference numerals as in FIGS. 2 and 3 are used to identify like elements.

The moisture removing device of FIGS. 4 and 5 differs from that of FIGS. 2 and 3 primarily in that the sealing strip 12 is replaced by a pair of discrete sealing strips 16 and 17 each of which extends along the outlet opening 6. The sealing strip 16 is mounted on the outside of the downstream wall of the upper enclosure portion 8 whereas the sealing strip 17 is mounted on the outside of the downstream wall of the lower enclosure portion 7. The sealing strips 16,17 extend beyond the edges of the respective walls and project towards one another from opposite sides of the outlet opening 6. When the moisture removing device is idle as in FIG. 4, the sealing strips 16,17 are in register with each other and cooperate to define a slit 18. The slit 18 is narrow so as to allow a vacuum to be maintained in the enclosure 7,8 during periods of idleness.

The sealing strips 16,17 are flexible and, when the moisture removing device is operative as in FIG. 5, the sealing strips 16,17 are drawn towards the interior of the enclosure 7,8 due to the suction generated by the suction nozzles 9,10. It will be observed that the sealing strips 16,17 are located on opposite sides of the bands 1,2,3. The flexibility of the sealing strips 16,17 is sufficiently great that the suction at the suction openings **9*a*,10*a* can cause air cushions to be developed and maintained between the sealing strips 16,17 and the neighboring sides of the bands 1,2,3. This makes it possible to reduce the likelihood of damage to the bands 1,2,3**.

Various other modifications of the moisture removing device of the invention, which have not been illustrated for the sake of simplicity, are contemplated. Thus, it may be of advantage for one of the portions 7,8 of the enclosure, together with the associated suction nozzle 9,10, to be resiliently mounted relative to the other portion 8,7 of the enclosure. This may be accomplished, for example, by resiliently mounting one of the portions 7,8 of the enclosure on a component of the wet processing apparatus other than the moisture removing device. Mounting of one of the portions 7,8 of the enclosure for resilient movement relative to the other portion 8,7 allows the resiliently movable portion to shift away from the other portion somewhat when the suction becomes excessive so that automatic adjustment of the vacuum may be achieved. If the bands 1,2,3 are provided with an emulsion on one side only, it is preferred for the portion of the enclosure which faces the emulsion side, e.g., the upper enclosure portion 8, to be resiliently mounted.

It is further possible to rotate the moisture removing device 90° from the orientation of FIGS. 1–5 so that it can be employed for film travelling along vertical paths.

The moisture removing device may also be arranged in such a manner that it is inclined, i.e., makes an acute angle with the horizontal. However, a greater number of mounting elements may then be required for the device.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the instant contribution to the art and, therefore, such adaptations should and are intended to be comprehended within the meaning and range of equivalence of the appended claims.

What is claimed is:

1. An apparatus for the continuous wet processing of photosensitive material, comprising a device for the removal of moisture from photosensitive material issuing from a processing bath and travelling along a predetermined direction, said device including an enclosure having first and second portions, and inlet and outlet openings for photosensitive material between said portions; and first and second suction nozzles respectively located in said first and second portions, each of said nozzles having a suction opening facing away from the respective portion of said enclosure.

2. The apparatus of claim 1, comprising suction generating means connected to said nozzles.

3. The apparatus of claim 1, wherein said enclosure is substantially airtight.

4. The apparatus of claim 1, wherein said suction openings are in register with one another.

5. The apparatus of claim 1, comprising separate first and second suction generating means respectively connected to said first and second suction nozzles.

6. The apparatus of claim 1, wherein said suction nozzles have substantially identical cross sections.

7. The apparatus of claim 1, said first portion of said enclosure having a pair of first edges each of which bounds one of said openings of said enclosure on one side, and said second portion of said enclosure having a pair of second edges each of which bounds one of said openings of said enclosure on the opposite side; and further comprising means for directing photosensitive material along a path lying nearer said second edges than said first edges.

8. The apparatus of claim 1, wherein one of said portions of said enclosure is resiliently mounted.

9. The apparatus of claim 1, said nozzles being elongated; and wherein said nozzles extend transversely of said predetermined direction.

10. The apparatus of claim 9, said enclosure having a predetermined width as considered transverse to said predetermined direction; and wherein said nozzles extend across at least the major part of said predetermined width.

11. The apparatus of claim 1, comprising a pair of sealing elements, said sealing elements being disposed on opposite sides of said suction openings.

12. The apparatus of claim 11, wherein a first sealing element is disposed between said inlet opening and said nozzles and the second sealing element is disposed downstream of said outlet opening, said sealing elements being arranged to at least partially close said inlet and outlet openings when said device is idle.

13. The apparatus of claim 1, wherein at least one of said suction nozzles comprises an arcuate section, and a pair of convergent legs extending from said arcuate section and defining the respective suction opening.

14. The apparatus of claim 13, wherein said arcuate section extends through an angle in excess of 180°.

15. The apparatus of claim 13, wherein said arcuate section is part-circular.

16. The apparatus of claim 13, said first and second portions of said enclosure having registering walls defining said outlet opening; and wherein one leg of at least one of said suction nozzles is disposed adjacent to the wall of the respective portion of said enclosure.

17. The apparatus of claim 16, wherein said one leg is substantially parallel to the respective wall.

18. An apparatus for the continuous wet processing of photosensitive material, comprising a device for the removal of moisture from photosensitive material issuing from a processing bath and travelling along a predetermined direction, said device including an enclosure having first and second portions, and inlet and outlet openings for photosensitive material between said portions; first and second suction nozzles respectively located in said first and second portions, each of said nozzles having a suction opening facing away from the respective portion of said enclosure; and sealing means for said enclosure including a first sealing element disposed between said inlet opening and said nozzles and a second sealing element disposed downstream of said outlet opening, said sealing elements being designed to at least partially close said inlet and outlet openings when said device is idle, and said sealing elements being further designed to be movable away from said inlet and outlet openings on the downstream sides of such openings to thereby open the latter.

19. The apparatus of claim 18, wherein said enclosure is substantially airtight when said sealing elements close said inlet and outlet openings, said nozzles being elongated and extending transversely of said predetermined direction; and further comprising suction generating means connected to said nozzles.

20. An apparatus for the continuous wet processing of photosensitive material, comprising a device for the removal of moisture from photosensitive material issuing from a processing bath and travelling along a predetermined direction, said device including an enclosure having first and second portions, and inlet and outlet openings for photosensitive material between said portions; first and second suction nozzles respectively located in said first and second portions, each of said nozzles having a suction opening facing away from the respective portion of said enclosure; and a pair of sealing elements, said sealing elements being disposed on opposite sides of said suction openings, and each of said sealing elements being arranged to at least partially close one of said openings of said enclosure when said device is idle, at least one of said sealing elements being arranged to overlie the respective opening of said enclosure when said device is idle, and said one sealing element being sufficiently flexible to be bent away from such opening when said device is in use and to be maintained at a distance from the path of the photosensitive material by the suction in said enclosure.

21. An apparatus for the continuous wet processing of photosensitive material, comprising a device for the removal of moisture from photosensitive material issuing from a processing bath and travelling along a predetermined direction, said device including an enclosure having first and second portions, and inlet and outlet openings for photosensitive material between said portions; first and second suction nozzles respectively located in said first and second portions, each of said nozzles having a suction opening facing away from the respective portion of said enclosure; and a pair of sealing elements, said sealing elements being disposed on opposite sides of said suction openings, and each of said sealing elements being arranged to at least partially close one of said openings of said enclosure when said device is idle, at least one of said sealing elements comprising a pair of discrete sealing strips which extend towards one another from opposite sides of the respective opening of said enclosure, and said sealing strips being in register with one another and cooperating to define a slit when said device is idle, each of said sealing strips being sufficiently flexible to be bent when said device is in use and to be maintained at a distance from the path of the photosensitive material by the suction in said enclosure.

* * * * *